US011825935B2

(12) United States Patent
Hall

(10) Patent No.: US 11,825,935 B2
(45) Date of Patent: Nov. 28, 2023

(54) TABLE ACCESSORY FOR A TOILET

(71) Applicant: Matthew Hall, Wilmington, DE (US)

(72) Inventor: Matthew Hall, Wilmington, DE (US)

( * ) Notice: Subject to any disclaimer, the term of this patent is extended or adjusted under 35 U.S.C. 154(b) by 45 days.

(21) Appl. No.: 17/566,976

(22) Filed: Dec. 31, 2021

(65) Prior Publication Data

US 2023/0049951 A1 Feb. 16, 2023

Related U.S. Application Data

(60) Provisional application No. 63/231,318, filed on Aug. 10, 2021.

(51) Int. Cl.

| | |
|---|---|
| ***A47B 23/02*** | (2006.01) |
| ***E03D 11/00*** | (2006.01) |
| ***A47B 9/00*** | (2006.01) |
| *A47K 17/02* | (2006.01) |

(52) U.S. Cl.

CPC ..... *A47B 23/02* (2013.01); *A47B 9/00* (2013.01); *E03D 11/00* (2013.01); *A47K 17/02* (2013.01)

(58) Field of Classification Search

CPC .. A47B 23/02; A47B 5/02; A47B 9/00; A47C 7/705; A47K 17/02; A47K 17/026; A47K 17/06; A47K 3/004; E03D 11/00; E04H 4/14

See application file for complete search history.

(56) References Cited

U.S. PATENT DOCUMENTS

| | | | | |
|---|---|---|---|---|
| 5,150,962 | A * | 9/1992 | Rauschenberger | F21V 33/004 362/802 |
| 5,228,711 | A * | 7/1993 | Summers | A61G 5/1094 297/161 |
| 6,079,786 | A * | 6/2000 | Kirkland | B63B 29/06 248/416 |
| 6,167,577 | B1 * | 1/2001 | Hammad | E03D 9/08 4/420.4 |
| 9,439,544 | B1 * | 9/2016 | DeCarlo | E03D 11/00 |
| 2007/0136940 | A1 * | 6/2007 | Cervi | A61G 5/1054 4/354 |
| 2009/0050770 | A1 * | 2/2009 | Perlman | A47B 23/04 248/346.11 |

FOREIGN PATENT DOCUMENTS

| | | | | |
|---|---|---|---|---|
| FR | 2963080 | A1 * | 1/2012 | A47B 23/02 |

* cited by examiner

*Primary Examiner* — Matthew W Ing
(74) *Attorney, Agent, or Firm* — Axenfeld Law Group, LLC

(57) ABSTRACT

A table carried at the distal end of a table leg that is configured for anchoring entirely on a toilet. The table leg is anchored at its proximal end to an upside-down J-bracket configured to couple with the rim of a toilet bowl. A J-bracket typically includes a clamping mechanism to horizontally squeeze the rim. Table elevation above floor level may be adjusted by way of a telescopic table leg, and/or a coupling mechanism between the proximal table leg end and the J-bracket. Horizontal orientation of the table top surface may be maintained by an anti-twist mechanism and an anti-roll mechanism.

20 Claims, 3 Drawing Sheets

148
140
144

140

Bottom
140

140

196
148
148
208

140
228
148

140

100
140
220
224
202'
284
168
172
176
172
172
176'
180
148
280
178
184
124

TABLE ACCESSORY FOR A TOILET

RELATED APPLICATIONS

This application claims the benefit under 35 U.S.C. 119(e) of the filing date of Provisional Application Ser. No. 63/231,318, filed Aug. 10, 2021, for "TABLE APPARATUS FOR A TOILET", the entire content of which is incorporated herein by reference.

BACKGROUND OF THE INVENTION

The Field of the Invention

The present invention relates to devices adapted to support objects on a surface that is disposed at a fixed position with respect to an anchor. In particular, a preferred embodiment provides a table configured to couple with a toilet anchor.

Related Art

U.S. Pat. No. 4,825,779, issued May 2, 1989 to Simms, entitled "Table for Toilet," discloses a table for storing a roll of toilet paper with a tabletop supported by legs at a height and an angle optionally usable by one seated on a toilet seat. The table shown in Simms stands separate and apart from the toilet, and requires floor space in the bathroom.

U.S. Pat. No. 6,983,493 issued Jan. 10, 2006 to Shaumyan entitled "Retractable Table Top for a Toilet" discloses a working surface for use by a person to place objects, such as a book, ashtray, etc. while seated on a toilet. The working surface is secured to a wall adjacent to a toilet, and includes support rods secured to the bottom of the working surface that extend to the ground in front of the toilet to support the working surface.

U.S. Patent Application Publication No. 2009/0050770 A1 published Feb. 26, 2009 entitled "Collapsible Bathroom Caddy" to Perlman discloses a collapsible caddy that includes a boom for holding objects on a tray attached to the boom. The boom extends from a free-standing base that rests on the floor apart from the toilet.

U.S. Pat. No. 9,439,533 issued Sep. 13, 2016 to DeCarlo entitled "Toilet Stool Table Assembly" discloses a toilet stool table for use by a person seated on the toilet. The assembly appears to require mounting through apertures located where the toilet seat attached to the back of the toilet bowl. The assembly also includes arms to support the user.

Most of the above apparatuses are either (i) free standing furniture, which may clutter the often-confined spaces of a bathroom and cause the user to store or move the furniture when not in use; or (ii) require installation into the wall and/or the back of the toilet itself. Therefore, there is a need for an improved table apparatus for toilets.

BRIEF SUMMARY

The invention may be embodied to provide a table assembly configured to couple with a toilet bowl to support a table entirely from the toilet. A preferred embodiment includes a table leg carried between a J-bracket and a table. An installed J-bracket resembles an upside-down letter "J", and includes a shelf, a cantilevered inner bracket leg depending from an inside end of the shelf, and a cantilevered outer bracket leg depending from an outer end of the shelf. The shelf provides a load-bearing surface of a floor disposed inside a socket. The J-bracket is installed so that the floor contacts in compression against a top surface of the rim of the toilet bowl. The proximal table leg end is coupled to the outer bracket leg to dispose a distal table leg end at a higher elevation than the proximal table leg end when the assembly is installed on the rim. The table is carried at the distal table leg end.

Sometimes, a clamp mechanism may be associated with the J-bracket. A workable clamp mechanism is operable to urge the inner bracket leg toward contact with the vertical inner surface of the rim. A preferred clamp mechanism includes a rotatable element coupled to a proximal end of a threaded shaft, a foot coupled to a distal end of the threaded shaft, and an intermediate portion of the threaded shaft received in threaded penetration through the outer bracket leg to permit placing the foot in compression against the vertical outer surface of the rim.

Sometimes, a clamp mechanism may include an interference member operably coupled to the J-bracket to create a structural interference with an outer surface portion of the toilet bowl. Desirably, that structural interference is created at an offset location disposed spaced apart from, and lower than, a line of action of force applied by the inner bracket leg to the rim. A load-carrying moment may then be applied to the toilet bowl by action of the inner bracket leg and the interference member. Sometimes, a protruding length of the interference member, between the J-bracket and the offset location, may be adjustable to cause a desired vertical orientation of the outer bracket leg.

A preferred table leg includes a telescopic portion to permit height adjustment of the table when the assembly is installed on the toilet rim. Desirably, a holding mechanism is included to resist change in a desired length, of the telescopic portion, in a direction parallel to a telescopic length axis.

Sometimes, an anti-twist mechanism may be included to resist twist rotation of a portion of the table leg about the telescopic length axis. One workable anti-twist mechanism includes a slot in a wall of a first telescopic member, the slot being elongate in a direction parallel to the telescopic length axis. A blocking element carried by a second telescopic member may then be disposed for reciprocation in the slot elongate direction. A workable blocking element causes a structural interference with walls of the slot to resist relative twist rotation between the first and second telescopic members. An alternative anti-twist mechanism includes telescopic inner and outer leg members with respective cross-sections configured to permit telescopic reciprocation, but to inherently cause a structural interference to resist relative twist rotation between the first and second leg members.

Certain embodiments may include an anti-roll mechanism to permit or resist rotation of the table about a table roll axis. A workable anti-roll mechanism is operable to place the table top in a horizontal plane.

Embodiments desirably include a coupling mechanism between the table leg and the J-bracket. A preferred coupling mechanism is operable to permit or resist a vertical displacement of the outer bracket leg with respect to the table.

One embodiment includes a J-bracket defining a socket disposed between inner and outer bracket legs, the socket being configured to couple with the rim of a toilet bowl such that a socket floor is placed into compression against a top surface of the rim. A table leg is coupled at one end to the outer bracket leg and coupled at the opposite end to a table. Clamping means are typically associated with the socket to apply a compression force to opposite sides of the rim. Preferably, means are provided to adjust an angle between a table leg length axis and the table's top surface. The embodiment also may include means to adjust elevation of the table top surface with respect to a floor elevation. One means to adjust elevation of the table top surface includes a vertically adjustable coupling means disposed between the J-bracket and the table leg. Another workable means to adjust elevation of the table top surface includes telescopic table leg extension means. An embodiment may also include means to resist twisting rotation of the table about a table leg length axis.

BRIEF DESCRIPTION OF THE DRAWINGS

In the drawings, which illustrate what are currently regarded as the best modes for carrying out the invention.

DETAILED DESCRIPTION

Figure 1:
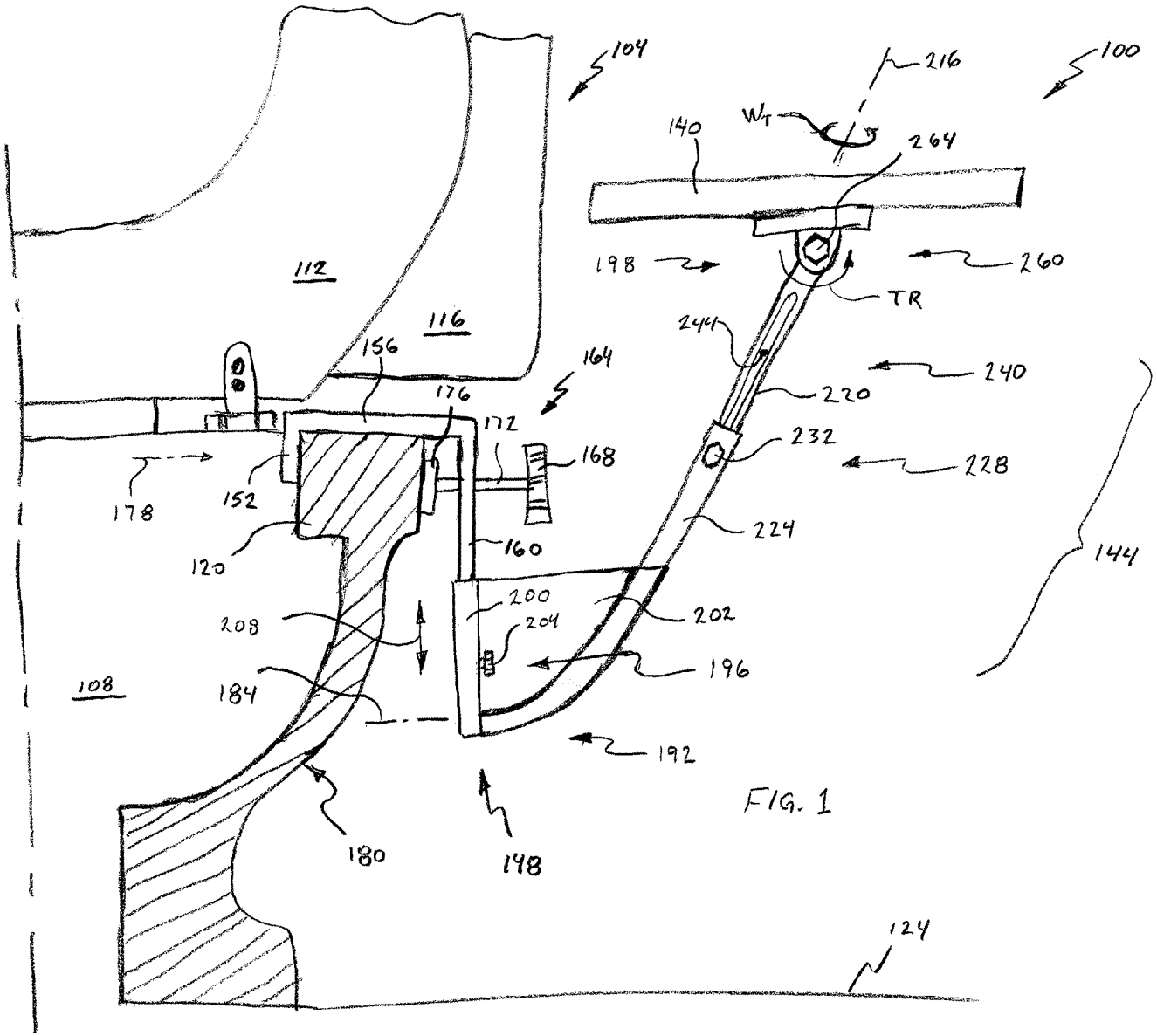
FIG. 1 is a front view in elevation, partially in cross-section, of an embodiment that is constructed according to certain principles of the instant invention and is installed on a cartoon illustration of a toilet (not to scale)
Figures 2, 3, 4, 5, 6, 7:
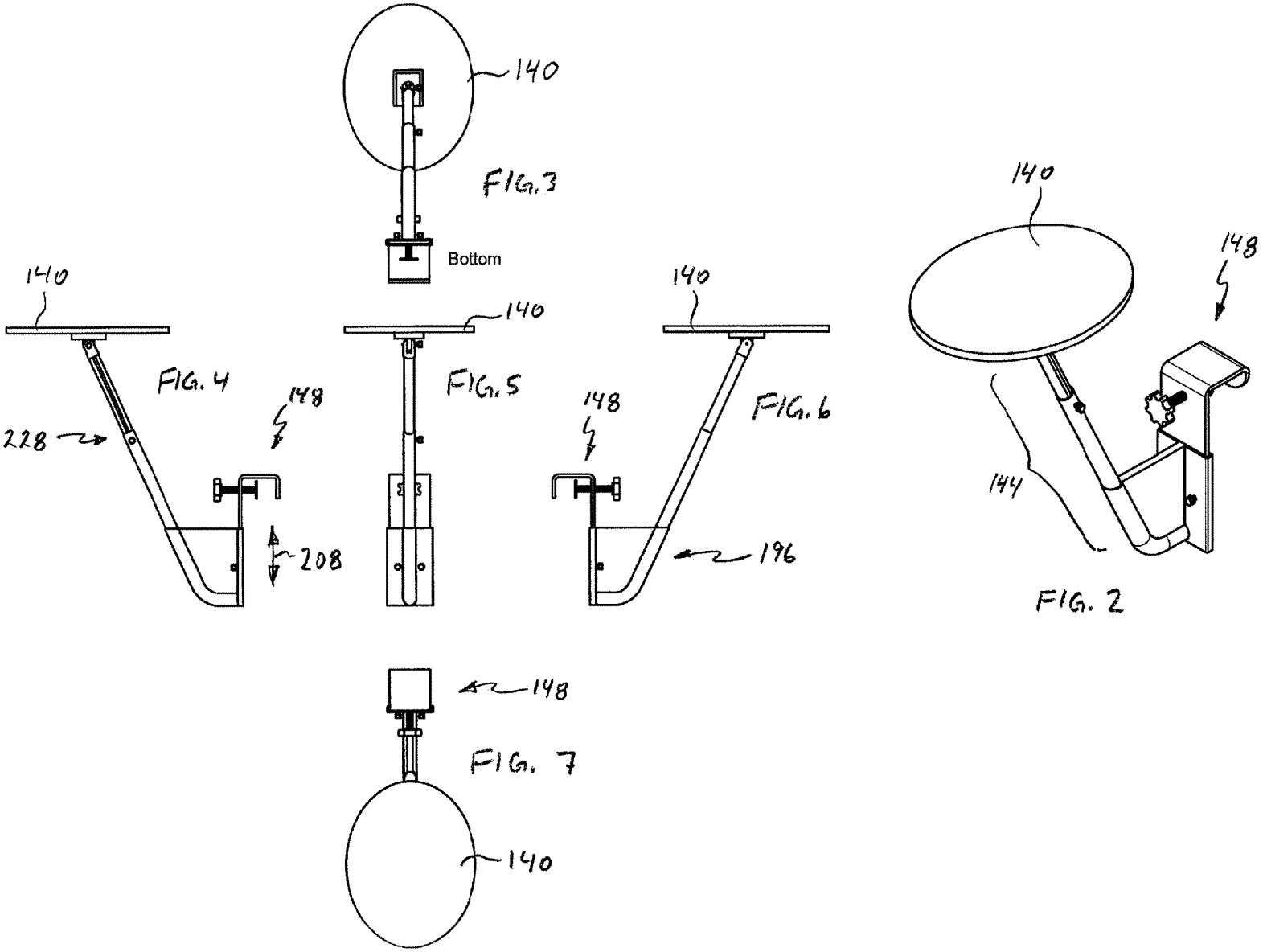
FIG. 2 is a view in perspective of the embodiment in FIG. 1.
FIG. 3 is a bottom view of the embodiment in FIG. 1.
FIG. 4 is a right side view in elevation of the embodiment in FIG. 1.
FIG. 5 is a front view in elevation of the embodiment in FIG. 1
FIG. 6 is a left side view in elevation of the embodiment in FIG. 1.
FIG. 7 is a top view of the embodiment in FIG. 1.

With reference to FIG. 1, the present invention provides a table assembly, generally indicated at 100, which may be supported entirely by a commercially available toilet, generally 104. For background/reference, toilet 104 includes a toilet bowel 108, a seat 112 (illustrated in a raised position), and a water reservoir tank 116. The top perimeter of the bowel 108 is defined by bowel rim 120. Typically, rim 120 has generally vertical and parallel inner and outer surfaces, and a horizontal top surface. The top surface of rim 120 is generally parallel to the bathroom floor 124. A toilet rim 120 provides a convenient support anchor that may be characterized as an upstanding wall or pillar.

Table assembly 100 includes a table 140, a table leg generally indicated at 144, and a J-bracket generally indicated at 148. J-bracket 148 resembles an upside-down letter "J", and is configured to couple with the rim 120. J-bracket 148 includes inner bracket leg 152, a horizontal shelf 156, and outer bracket leg 160. The bracket legs 152, 160 extend downwardly from cantilevered attachment at opposite ends of the shelf 156. The shelf 156 provides a load-bearing surface of a socket floor that is configured to rest on the top surface of rim 120. As illustrated in FIG. 1, the floor is disposed in a plane that is vertically offset from depending ends of the inner and outer legs 152, 160.

A clamp mechanism, generally indicated at 164, may be included to enhance a connection between J-bracket 148 and rim 120. The illustrated clamp mechanism 164 includes a rotatable member 168 affixed to one end of a threaded shaft 172. The shaft 172 extends through a threaded opening in outer depending bracket leg 160 and terminates at clamp foot 176. Consequently, rotation of member 168 causes foot 176 to either move toward or away from the inner depending bracket leg 152, depending on direction of rotation. Rotation of member 168 in a tightening direction causes bowl rim 120 to be squeezed between inner bracket leg 152 and clamp foot 176. A line of action of a force applied by inner bracket leg 152 onto rim 120 is indicated by arrow-headed line 178.

Many alternative workable clamp arrangements 164 may be envisioned. For example, it is within contemplation that a clamp mechanism 164 may cause a distance between the legs 152, 160 to be a controllable variable. In that case, the outer bracket leg 160 may directly contact the outer sidewall of bowl rim 120, and the rim 120 can be squeezed between the bracket legs 152, 160.

It is within contemplation that a brace member may be included to brace against the bowl's outer surface 180 at a location spaced apart from, and below, the rim 120. An exemplary force line of action for one such brace member is illustrated by centerline 184. A brace member may sometimes be variably extendable between bracket and toilet to conform to a variety of toilets having different shapes. A brace member may supplement or even replace a clamp mechanism 164.

The proximal table leg end 192 may be coupled to the outer bracket leg 160 by way of a coupling mechanism, generally indicated at 196. Certain coupling mechanisms 196 may permit assembly at a user's location. Such an arrangement permits a reduction in the shipping volume of a partially-assembled assembly 100. It is currently preferred that the table leg 144 is coupled to the J-bracket 148 at an angle to dispose a distal table leg end, generally 198, at a higher elevation than proximal table leg end 192. However, it is within contemplation that an assembly 100 may alternatively be configured with a vertical table leg 144.

Illustrated coupling mechanism 196 includes a rectangular socket 200 in which to receive the free end of bracket leg 160. As also illustrated, a gusset 202 may be included to increase strength of the connection between the J-bracket 148 and table leg 144. The bracket leg 160 may be retained inside the socket 200 by a clamping element, such as one or more bolt 204. Sometimes, a clamping mechanism 196 may provide a vertical adjustment capability 208 to refine the elevation of an installed table 140 with respect to, e.g., the toilet rim 120. For example, the outer bracket leg 160 may be held at a selected one of a plurality of depths of insertion into socket 200.

It is currently preferred that table leg 144 is adjustable in length. The illustrated table leg 144 is configured for telescopic reciprocation along telescopic length axis 216. Rod 220 is closely received for sliding inside tube 224. A holding mechanism, generally indicated at 228, can be adjusted to maintain rod 220 at a desired position with respect to tube 224. The exemplary holding mechanism 228 includes a clamping element, such as illustrated machine bolt 232. Bolt 232 engages a threaded portion of tube 224 to permit the free end of the rotated bolt to press onto the rod 228 and create a friction clamp between the rod and tube.

An anti-twist mechanism, generally indicated at 240, may be included in certain embodiments 100. A workable anti-twist mechanism 240 includes slot 244 disposed in rod 220. Slot 244 is elongate in the telescopic length direction and receives the free end of bolt 232. The bolt 232 causes a structural interference with walls of the slot 244 to resist relative rotation WT between the rod 220 and tube 224 and about telescopic length axis 216.

An alternative anti-twist mechanism 240 may be provided by the inherent interference between non-round cross-sections of certain cooperating rods and tubes. For example, close fitting rods and tubes having rectangular cross-sections would inherently resist relative rotation WT.

Certain embodiments 100 may include an anti-roll mechanism, generally indicated at 260. A workable mechanism 260 may be operated to maintain the table 140 at a desired horizontal orientation. Illustrated anti-roll mechanism 260 includes a machine bolt 264 to affix the table 140 at the distal table leg end 198. Tightening the bolt 264 is operable to resist table rotation TR about a roll axis defined by the centerline of bolt 264.

Figure 8:
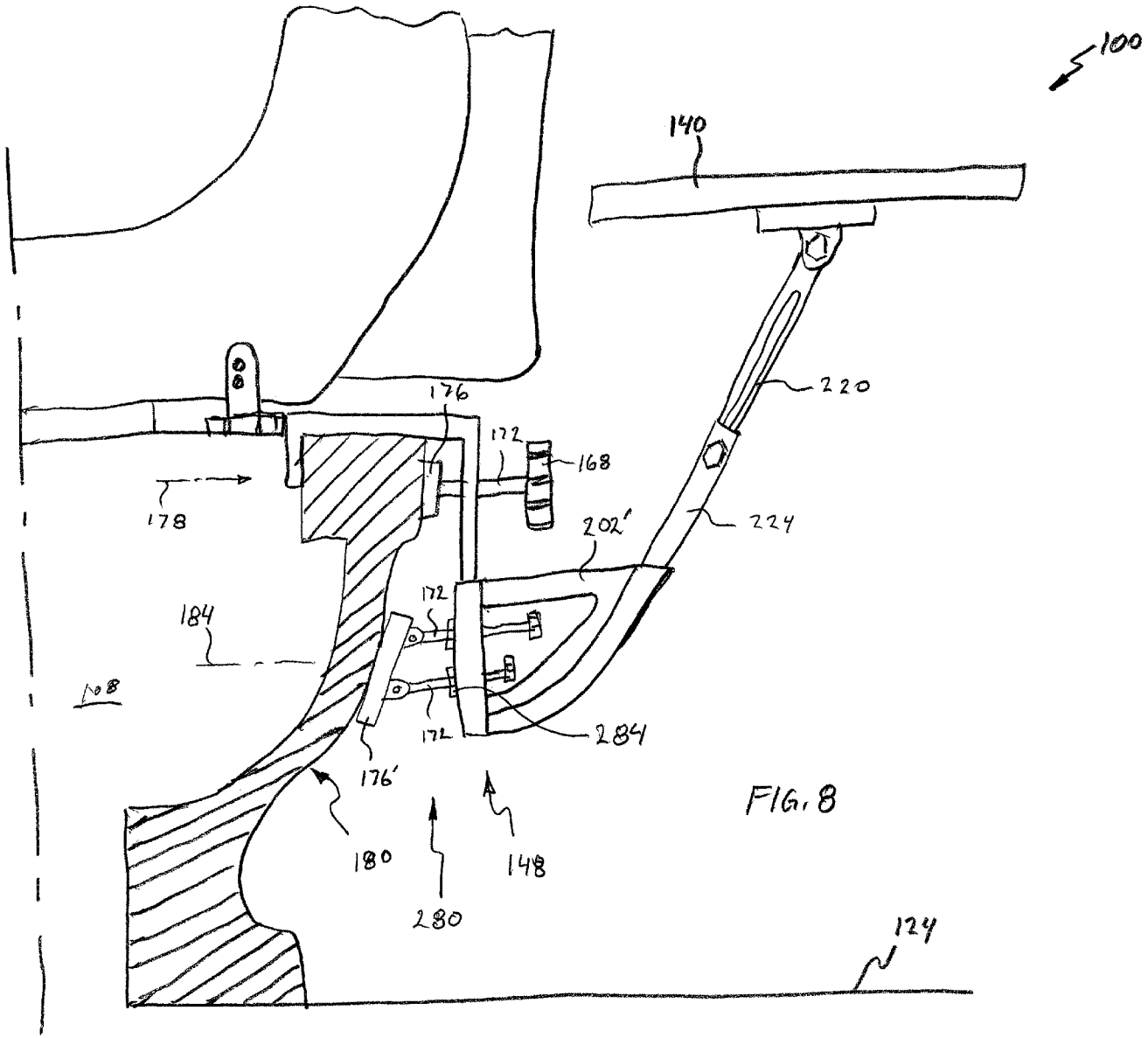
FIG. 8 is a view similar to that in FIG. 1, of an alternative embodiment.

An exemplary brace member to enhance a table's anchor is generally indicated at 280 in FIG. 8. Brace member 280 includes a pair of threaded shafts 171 that are rotatable coupled to foot 176'. A workable shaft 272 includes a machine bolt received to slide in an aperture through the J-bracket 148. An extended shaft length between the surface 180 and the J-bracket 148 may be adjusted with jam nuts 284. Modified gusset 202' includes a central aperture to generally align shafts 272 in the plane of table support load. It is within contemplation to include a resilient surface, such as rubber, as the contact surface between foot 176' and outer surface 180.

While aspects of the invention have been described in particular with reference to certain illustrated embodiments, such is not intended to limit the scope of the invention. The present invention may be embodied in other specific forms without departing from its spirit or essential characteristics. The described embodiments are to be considered as illustrative and not restrictive. Obvious changes within the capability of one of ordinary skill are encompassed within the present invention. All changes which come within the meaning and range of equivalency of the claims are to be embraced within their scope.

What is claimed is:

1. An apparatus to couple with an upstanding support anchor, the apparatus comprising:

a J-bracket comprising a shelf, a cantilevered inner bracket leg depending from an inside end of the shelf, and a cantilevered outer bracket leg depending from an outer end of the shelf, the shelf to provide a load-bearing surface of a socket floor, the floor being disposed in a plane that is vertically offset from depending ends of the inner and outer bracket legs, the load-bearing surface to contact in compression against a top surface of the support anchor;

a table leg comprising a proximal table leg end coupled to the outer bracket leg to dispose a distal table leg end at a higher elevation than the proximal table leg end when the apparatus is installed on the support anchor; and a table carried at the distal table leg end, wherein:

coupling elements between the proximal table leg end and the outer bracket leg are configured in harmony to resist substantial rotation of a length axis of the table leg with respect to the J-bracket, and consequently, cause the table leg to always remain at a substantially single angular orientation with respect to the J-bracket during conventional use of the apparatus; and the table leg is configured to resist rotation of the table about the table leg length axis.

2. The apparatus according to claim 1, further comprising:

a clamp mechanism associated with the J-bracket, the clamp mechanism to urge the inner bracket leg toward contact with a first cooperating surface of the support anchor.

3. The apparatus according to claim 2, wherein:

the clamp mechanism comprises a rotatable element coupled to a proximal end of a threaded shaft, a foot coupled to a distal end of the threaded shaft, and an intermediate portion of the threaded shaft received in threaded penetration through the outer bracket leg to permit placing the foot in compression against a second cooperating surface of the support anchor.

4. The apparatus according to claim 2, wherein:

the first cooperating surface of the support anchor is an inner surface; and the clamp mechanism comprises a brace member operably coupled to the J-bracket to create a structural interference with an outer surface portion of the support anchor.

5. The apparatus according to claim 4, wherein:

the structural interference is created at an offset location disposed spaced apart from, and lower than, a line of action of force applied by the inner leg to the support anchor.

6. The apparatus according to claim 5, wherein:

a protruding length of the brace member, between the J-bracket and the offset location, is adjustable to cause a desired vertical orientation of the outer bracket leg.

7. The apparatus according to claim 1, wherein:

the table leg comprises a telescopic portion to permit height adjustment of the table when the apparatus is installed on the support anchor.

8. The apparatus according to claim 7, further comprising:

a holding mechanism to resist change in length, of the telescopic portion, in a direction parallel to a telescopic length axis.

9. The apparatus according to claim 8, further comprising:

an anti-twist mechanism to resist twist rotation of a portion of the table leg about the telescopic length axis.

10. The apparatus according to claim 9, wherein:

the anti-twist mechanism comprises a slot in a wall of a first telescopic member, the slot being elongate in a direction parallel to the telescopic length axis; and a blocking element carried by a second telescopic member and disposed for reciprocation in the slot elongate direction, the blocking element to cause a structural interference with walls of the slot to resist relative twist rotation between the first and second telescopic members.

11. The apparatus according to claim 9, wherein:

the anti-twist mechanism comprises telescopic inner and outer leg members with respective cross-sections configured to permit telescopic reciprocation, but to inherently cause a structural interference to resist relative twist rotation between the first and second members.

12. The apparatus according to claim 7, further comprising:

a telescopic coupling mechanism between the table leg and a portion of the cantilevered outer bracket leg, the coupling mechanism operable to permit or resist a vertical displacement of the outer bracket leg with respect to the table.

13. The apparatus according to claim 1, further comprising:

an anti-roll mechanism operable to permit or resist rotation of the table about a table roll axis.

14. An apparatus, comprising:

a J-bracket defining a socket disposed between inner and outer bracket legs, the socket being configured to couple with the rim of a toilet bowl such that a socket floor is placed into compression against a top surface of the rim;

a table with a top surface;

a table leg coupled at one table leg end to the outer bracket leg to always maintain a substantially single angular orientation of a table leg length axis with respect to the outer bracket leg and coupled at the opposite table leg end to the table, the table leg being configured to resist rotation of the table about the table leg length axis; and clamping means associated with the socket to apply a compression force to opposite sides of the rim.

15. The apparatus according to claim 14, further comprising:

means to adjust an angle between a table leg length axis and the table top surface.

16. The apparatus according to claim 14, further comprising:

means to adjust elevation of the table top surface with respect to a floor elevation.

17. The apparatus according to claim 16, wherein:

the means to adjust elevation of the table top surface comprises telescopic coupling means disposed between the outer bracket leg and the table leg.

18. The apparatus according to claim 16, wherein:

the means to adjust elevation of the table top surface comprises telescopic table leg extension means.

19. The apparatus according to claim 14, further comprising:

means to resist rotation of the table about a table leg length axis.

20. An apparatus, comprising:

a J-bracket comprising a floor, a cantilevered inner bracket leg depending from an inside end of the floor, and a cantilevered outer bracket leg depending from an outer end of the floor, the floor to provide a load-bearing surface, the load-bearing surface being disposed in a plane that is vertically offset from depending ends of the inner and outer bracket legs, the load-bearing surface being configured to contact in compression against a top surface portion of the rim of a toilet bowl;

a table leg comprising a proximal table leg end coupled to the J-bracket to dispose a distal table leg end at a higher elevation than the proximal table leg end when the apparatus is installed on the rim, the table leg further comprising a telescopic portion to permit height adjustment of the table when the apparatus is installed on the rim;

a holding mechanism to resist change in length, of the telescopic portion of the table leg, in a direction parallel to a telescopic length axis;

an anti-twist mechanism to resist relative twist rotation between telescopically reciprocating portions of the table leg and about the telescopic length axis;

a table carried at the distal leg end;

a clamp mechanism associated with the J-bracket, the clamp mechanism to urge the inner bracket leg toward contact with an inner surface portion of the rim, the clamp mechanism comprising a rotatable element coupled to a proximal end of a threaded shaft, a foot coupled to a distal end of the threaded shaft, and an intermediate length of the threaded shaft received in threaded penetration through the outer leg to permit placing the foot in compression against an outer surface portion of the rim;

an anti-roll mechanism operable to permit or resist rotation of the table about a table roll axis; and a coupling mechanism between the table leg and the outer bracket leg, the coupling mechanism operable to permit or resist a vertical displacement of the outer bracket leg with respect to the table when the apparatus is installed on the rim the coupling mechanism configured to always maintain a substantially single angular orientation of a table leg length axis with respect to the outer bracket leg.

* * * * *